United States Patent [19]

Schaffer et al.

[11] Patent Number: 4,870,906

[45] Date of Patent: Oct. 3, 1989

[54] DUAL SWITCH SYSTEM FOR COMMON USE BY TRACK GUIDED RAIL VEHICLES AND MAGNETIC VEHICLES

[75] Inventors: Gottfried Schaffer, Immenstaad; Gert Schwindt, Gröbenzell, both of Fed. Rep. of Germany

[73] Assignee: Thyssen Industrie AG, Fed. Rep. of Germany

[21] Appl. No.: 168,693

[22] Filed: Mar. 16, 1988

[30] Foreign Application Priority Data

Mar. 24, 1987 [DE] Fed. Rep. of Germany ..... 3709619

[51] Int. Cl.[4] ..... E01B 25/12

[52] U.S. Cl. ..... 104/130.1; 246/434

[58] Field of Search ..... 104/130, 130.1, 35, 104/47; 246/417, 418, 415 R, 430, 434, 445, 446, 447; 238/151, 165, 166, 169, 171, 174, 175, 218, 223, 225, 227, 228

[56] References Cited

U.S. PATENT DOCUMENTS

| | | | |
|---|---|---|---|
| 955,809 | 4/1910 | King | 104/47 |
| 1,585,337 | 5/1926 | Feuerlein | 246/446 |
| 3,093,090 | 6/1963 | Rosenbaum | 104/130 |
| 3,193,675 | 7/1965 | Parkes et al. | 246/434 X |
| 3,528,608 | 9/1970 | Dashew et al. | 238/175 X |
| 3,847,088 | 11/1974 | Karch | 104/130.1 |
| 3,854,411 | 12/1974 | Lichtenberg | 104/130.1 |

FOREIGN PATENT DOCUMENTS

| | | | |
|---|---|---|---|
| 2544665 | 4/1977 | Fed. Rep. of Germany | 104/130.1 |
| 3420260 | 12/1985 | Fed. Rep. of Germany | 104/130.1 |

*Primary Examiner*—Johnny D. Cherry
*Assistant Examiner*—Frank H. Williams, Jr.

[57] ABSTRACT

The invention relates to a dual track system for rail vehicles and magnetic vehicles. To enable this track system to be used in common by conventional wheel-and-track vehicles and magnetic vehicles, switches are needed by which both types of vehicle can be switched from a track on which only the one type of vehicle can run to a track which can be used by both types of vehicle. Furthermore, the switch must be suited for providing branches in a track on which both types of vehicles can operate. For the solution of this problem the invention provides a switch system which is essentially characterized by a flexible beam (6*a*) on which a likewise flexible track section (21) is mounted, which is intended for common use by rail vehicles and magnetic vehicles, and by an apparatus (31) for opening or closing a gap (30) between the beam and each such track (1*a*) to be traversed by the rail vehicles which permits the flexing of the beam.

9 Claims, 7 Drawing Sheets

Figure 1:
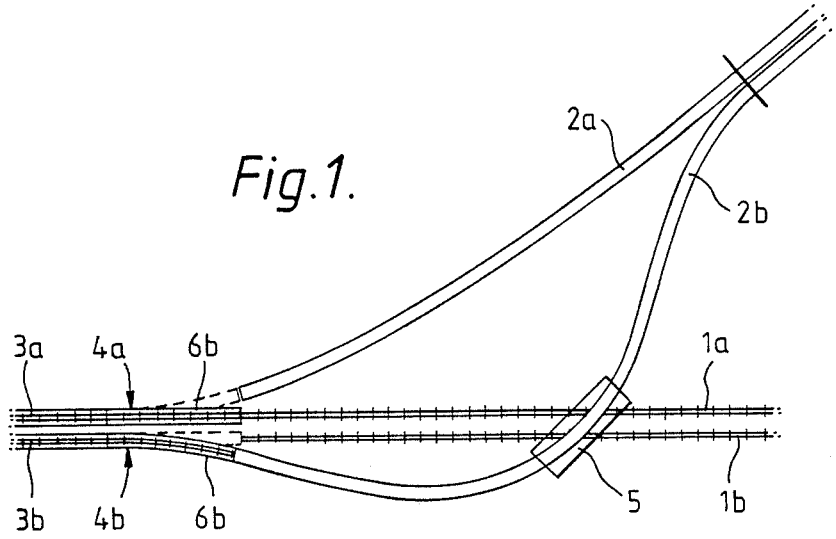

DUAL SWITCH SYSTEM FOR COMMON USE BY TRACK GUIDED RAIL VEHICLES AND MAGNETIC VEHICLES

BACKGROUND OF THE INVENTION

The invention relates to a dual switch system for common use by track guided rail and magnetic vehicles.

Track guided transport means include not only the classical rail vehicles such as trains and streetcars but also certain buses and the magnetic transit systems based on contactless magnetic technology, especially so-called magnetic levitation railways, which can be generally classed as magnetic vehicles. Since the latter heretofore have been guided on separate ways, usually supported on pillars, there is a need, particularly in the areas of cities and other traffic centers (e.g., railroad yards), but also in the area of bridges and tunnels, for dual track systems which can be used in common by rail vehicles and magnetic vehicles.

The principles of dual track systems of this kind are already known ("Magnetfahrtechnik" 6/86, Thyssen Henschel, under "Neue Verkehrstechnologien"). Their use, however, has been blocked by the fact that there are no dual switches which would make it possible for a rail car or magnetic car to pass through commonly used branches or to change over from the dual track system to a track on which only rail vehicles or only magnetic vehicles can operate.

There are substantially two reasons for the lack of such dual switches. On the one hand, magnetic vehicles are not guided on conventional Vignoles' rails or tramway rails, but on tracks provided with such functional components as guide rails, slide rails, stators or the like, and, for the avoidance of derailments, are so made that they hook around the inner side or the outer side of at least part of the track. This bars from dual-purpose applications the classical wheel-and-track switches equipped with switchpoints and frogs. On the other hand, the switches heretofore developed for magnetic vehicles are based on a design principle that is basically different from that of wheel-and-track systems. The known switches for magnetic vehicles consist of so-called "flex switches" ("Magnetfahrtechnik" 6/86, Thyssen Henschel, under "Neue Verkehrstechnologien") which consist essentially of a flexible track holder whose front end is fixedly joined to the arriving track and whose back end can be aligned with one or more branch tracks by resiliently bending the entire track holder. For dual use such flex switches are no more suitable than the switches that have switchpoints and frogs for rail vehicles.

The common use of track systems by different conveyance means is known, for example, in the case of track guided buses and street cars (Verkehr and Technik 1986, pp. 247–251). The tracks developed for these vehicles consist of at least one track for street cars and ways on both sides beside that track for buses. To change over from a common track system of this kind to ways used exclusively by one or the other type of vehicle, switches are used which have in the part associated with the streetcar the frogs and switchpoints associated with Vignoles' track or tramway track. In the part that serves for track-guided buses, these switches have, depending on the type of bus, vertically movable guide rails for guide rollers mounted on the exterior of the bus, or swiveling points for a guide roller situated in the center of the bus track. An analogous application of this principle to dual track systems for rail vehicles and magnetic vehicles, however, is not possible because of the great difference between the modes of guidance of track-guided buses and magnetic vehicles.

It is the aim of the invention to create a switch system permitting the selective transfer from a track traveled both by conventional wheel-and-rail vehicles and by conventional magnetic vehicles onto ways which can be traveled by only one of the two types of vehicles, and vice-versa, whereby any desired branching of ways used in common by rail vehicles and magnetic vehicles can be constructed.

SUMMARY OF THE INVENTION

The dual switch system according to this invention comprises:

(a) a flexible beam with a beginning for tight and rigid connection to a track on which the rail and magnetic vehicles can commonly run, and with an end for selective alignment with one of several branch tracks on which both rail vehicles and magnetic vehicles or only rail vehicles or only magnetic vehicles can run, leaving in either case a gap permitting the flexing of the beam, (b) a likewise flexible track section mounted on the beam, running from its beginning to its end, and intended for common use by rail vehicles and magnetic vehicles, (c) at least one actuating means for the flexing of the beam for the purpose of selective alignment of its end with one of the branch tracks, and (d) an apparatus for opening or closing the gaps between the end of the beam and each branch track which can be traversed by the rail vehicles. According to the invention, instead of the formerly common switch designs, a switch operating on the principle of the flex switch is provided also for rail vehicles. In this manner it is possible in a simple manner to use the switch both for rail vehicles and for magnetic vehicles without the need to depart from the track guidance that has commonly been used heretofore for magnetic vehicles. Furthermore, the switch system according to the invention is simple in construction and can also be remotely controlled by the switch actuating means. For the unhampered flexing of the beam bearing the track section on apparatus is provided by means of which a sufficiently great gap can be produced between the switch and each rail vehicle branch track and can be closed whenever a rail vehicle is to pass through the switch system.

Figure 2:
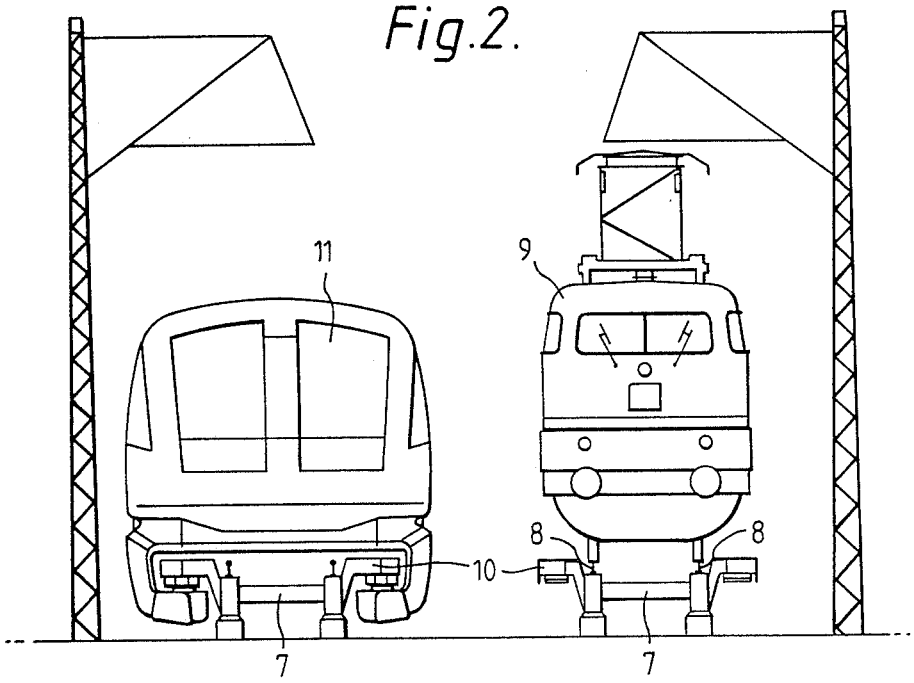
Figure 3:
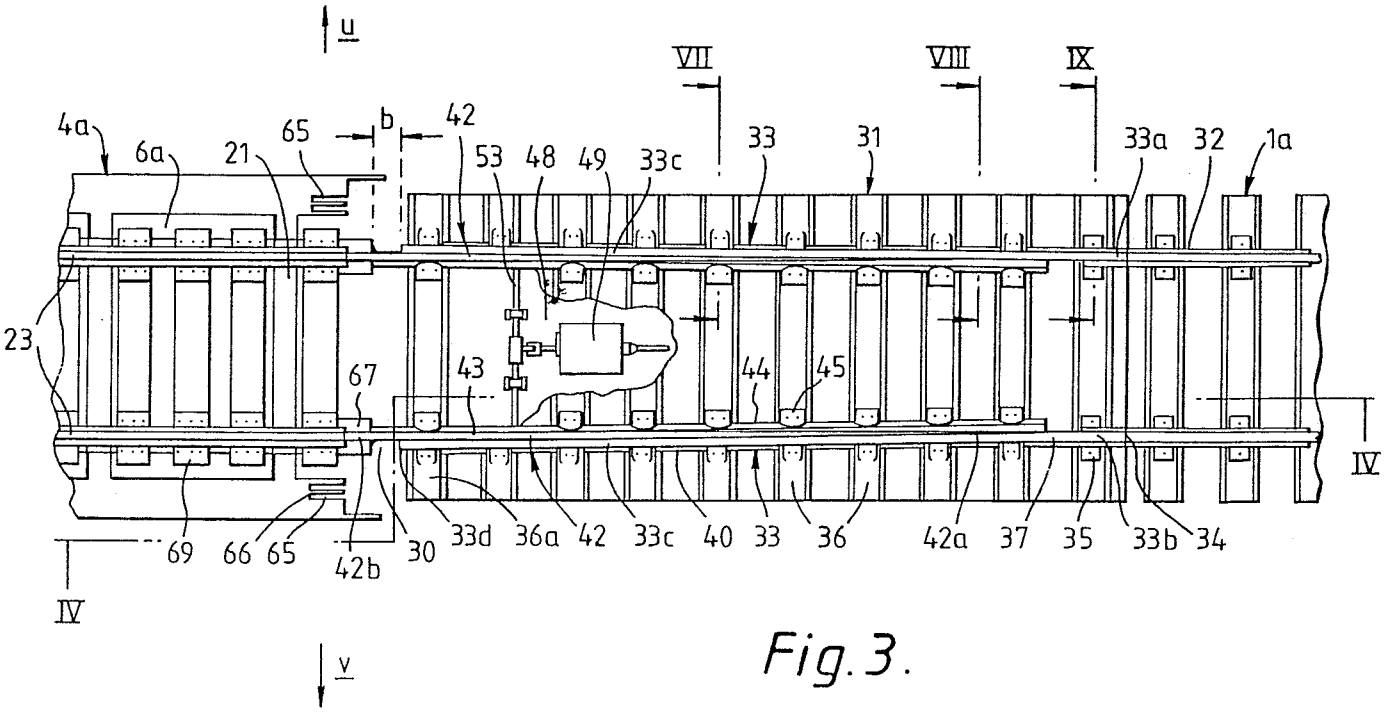
Figure 4:
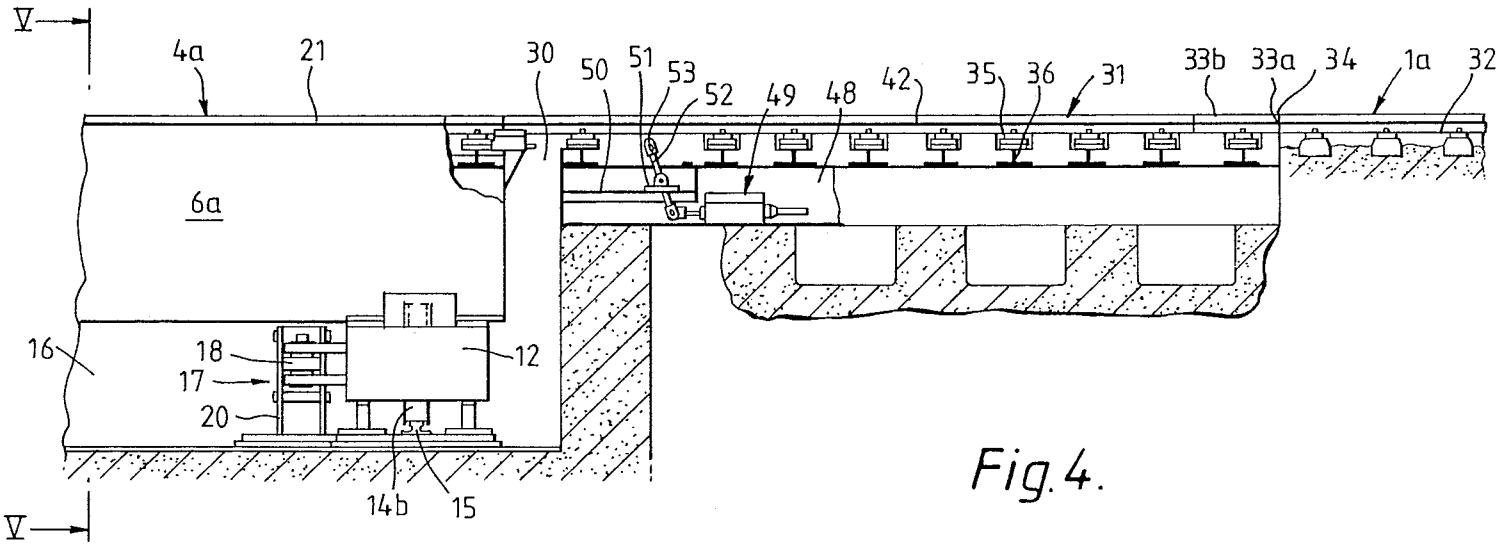
Figure 5:
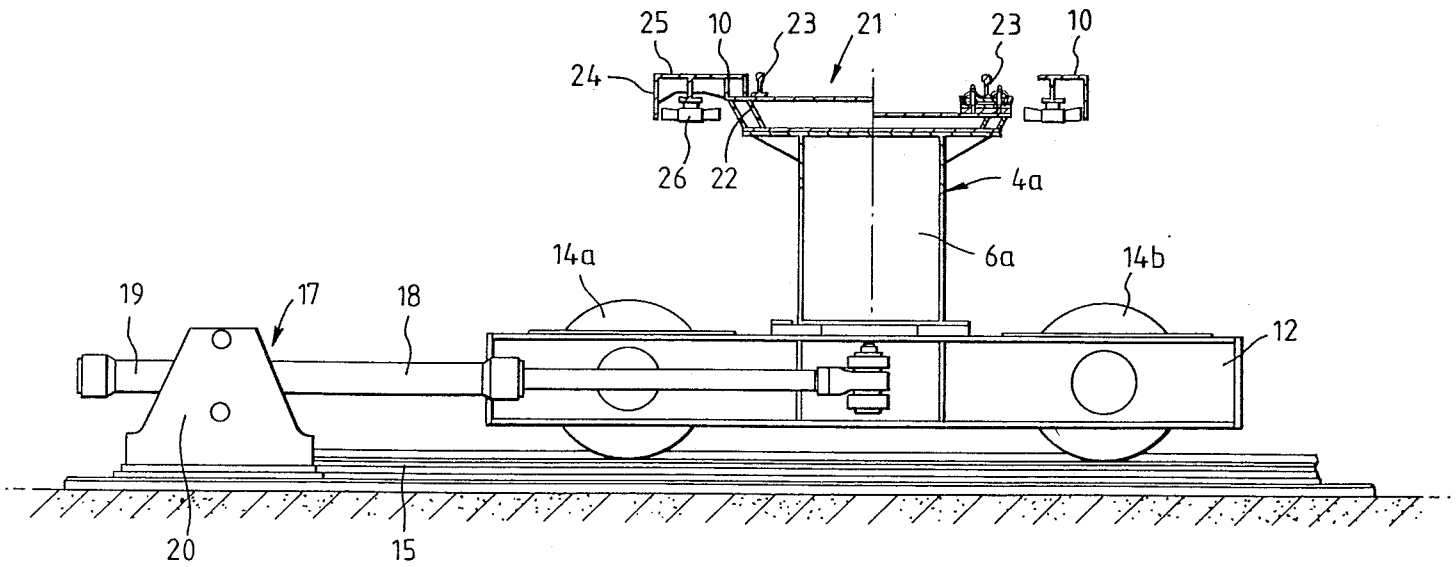
Figure 6:
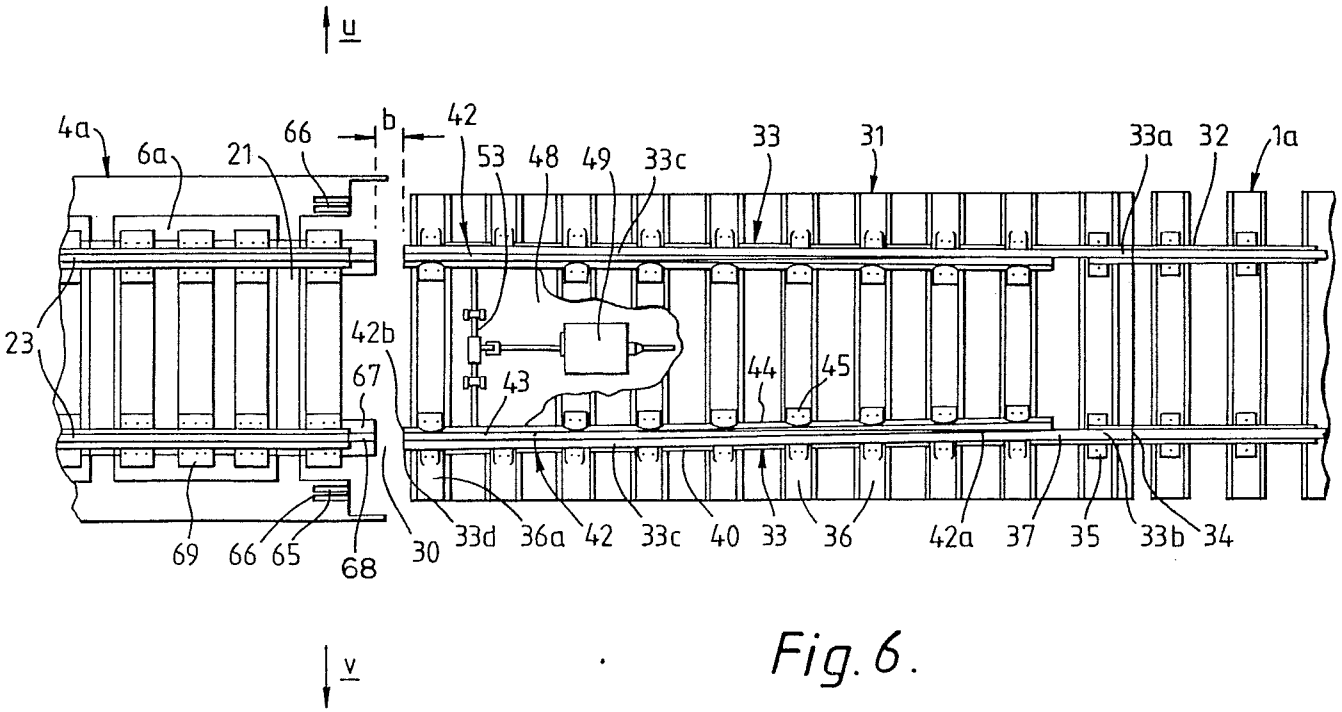
Figure 7:
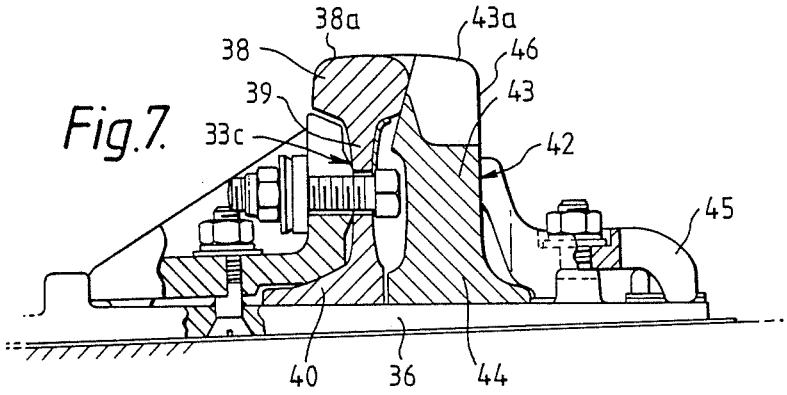
Figure 8:
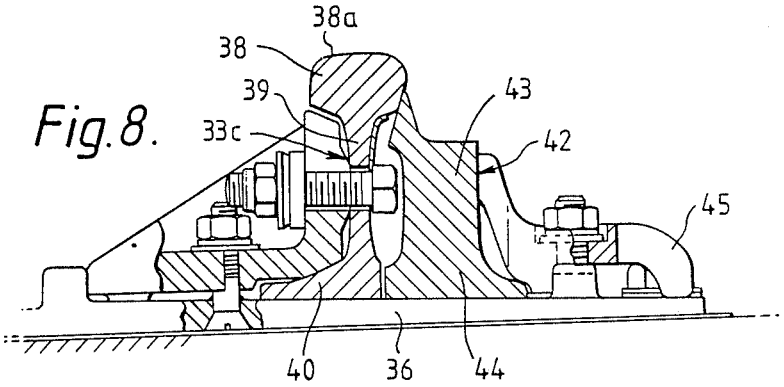
Figure 9:
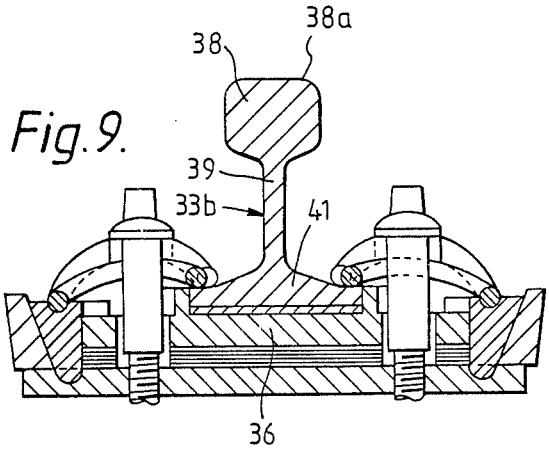
Figure 10:
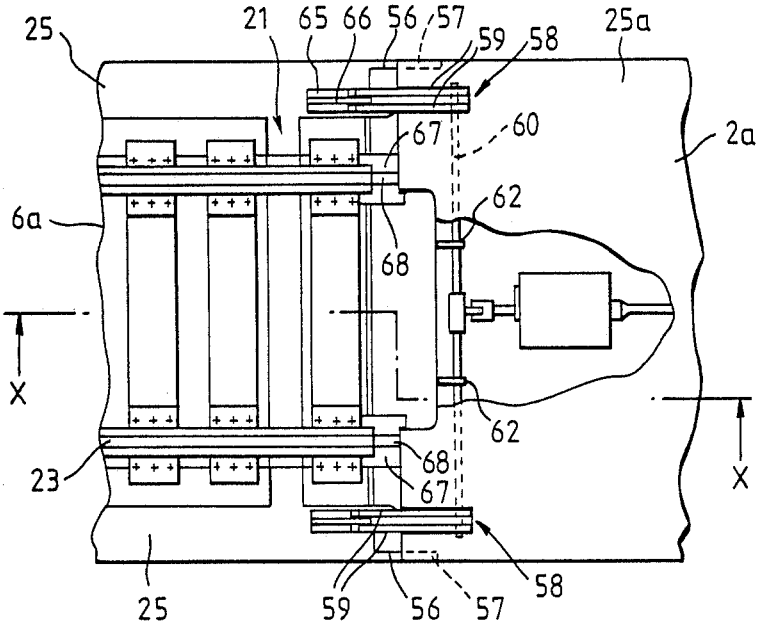
Figure 11:
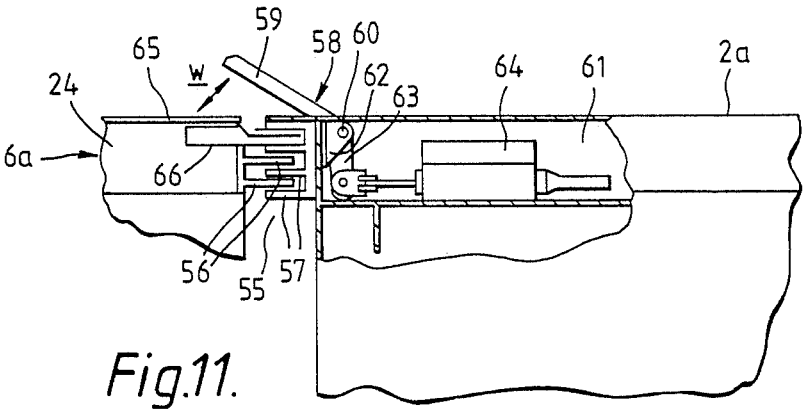

The invention will be explained below with reference to a preferred embodiment and in connection with the appended drawing, wherein:

FIG. 1 is a diagrammatic plan view of a switch system according to the invention, FIG. 2 is a diagrammatic front view of a track which can be used in common by rail vehicles and magnetic vehicles, FIG. 3 is an enlarged top plan view of a portion of the switch system of FIG. 1, with the switch aligned with a track that can be traveled by rail vehicles and with the gap between the switch and the track closed, FIG. 4 is a section along line IV—IV of FIG. 3, FIG. 5 is a section along line V—V of FIG. 4, FIG. 6 is a view similar to FIG. 3 with the gap between the switch and the track open, FIGS. 7 to 9 are sections along lines VII—VII to IX—IX of FIG. 3, FIG. 10 is an enlarged plan view of a portion of the switch of the switch system of FIG. 1 on a track to be traveled by magnetic vehicles, with the gap between the switch and the track closed, and FIG. 11 is a section along line X—X of FIG. 11.

FIG. 1 is a diagrammatic representation of a two-track, dual rail system having two tracks 1a and 1b in the form of conventional rails for a rail vehicle, e.g., a railroad or streetcar line, two tracks 2a, 2b, for a magnetic vehicle, and two dual tracks 3a and 3b which can be used in common by rail vehicles and magnetic vehicles. In the area of a branch, two switch systems according to the invention with two switches 4a and 4b are disposed, by means of which the tracks 3a and 3b can be connected selectively with one of the branch tracks 1a and 1b or 2a and 2b, respectively. With the switches 4a and 4b in the position represented, the track 3a is connected with track 1a and track 3b with track 2b, which runs over a diagrammatically indicated bridge 5 and then continues on parallel to track 2a. The other possible switch positions ar represented by broken lines.

The switches 4a and 4b are, according to the invention, flex switches, and each has a continuous flexible beam, e.g., one made of steel, whose front end is fixedly disposed and is permanently aligned, across the conventional expansion gap, with the dual tracks 3a and 3b. On the other hand, the remainder of the beam 6a, 6b, is mounted for flexing transversely of its longitudinal axis so that its free end can be aligned with the corresponding tracks 1a, 1b and 2a, 2b, respectively. To permit easy flexing of the beam 6a, 6b, it can have a length, for example, of 150 meters.

As shown in FIG. 2, each of the dual tracks 3a and 3b consists of a supporting structure 7 on which, in a middle part, two rails 8 are fastened for a conventional rail vehicle 9 having flanged wheels. Two side arms 10 of the supporting structure 7 as well as working components fastened thereto serve for the derailment-proof guidance of a magnetic vehicle whose lower section is hooked around the side arms 10. The tracks 1a and 1b and tracks 2a and 2b are constructed in the same manner, yet in the one case the side arms 10 are lacking and in the other case the rails 8 are lacking, so that only one type of vehicle can travel them. Alternatively the tracks 1a, 1b, and 2a, 2b, can consist of the known component assemblies for the rail and magnetic vehicles 9, 11, with the appropriate substructure.

The switch according to the invention will now be described on conjunction with switch 4a. Switch 4b can be configured in the same manner.

According to FIGS. 3 to 5, the flexible beam 6a consists of a box or hollow member of rectangular cross section. With it is associated at least at one end pointing toward tracks 1a or 2a, an actuating apparatus which has a frame 12 on which the beam 6a is mounted and which is supported by movement by means of wheels 14a and 14b on a cross member 15 which is disposed substantially perpendicular to the longitudinal axis of the tracks 3a or 1a, but could also be curved. The cross member is anchored to the bottom of a pit 16 created underneath the switch 4a. The frame 12 is connected to a driver 17, e.g., a hydraulic cylinder and piston unit whose connecting rod 18 is articulated to a bearing stand 20. By the operation of the driver 17 the frame 12 can be moved back and forth on the cross member 15 and thus the beam 6a can be flexed relative to its fixed end.

A plurality of actuating means of this kind are associated with the flexible beam 6a with frames 12 spaced along its length, each being connected to a driver similar to the driver 17. By the independent operation of all drives it is then possible to flex the beam 6a along a preselected curve, consisting, for example, of clothoid, radius and clothoid. On the upper side of the beam 6a there is mounted, according to the invention, a track section 21 which like track 3a contains a supporting structure 22 which is provided in a central portion with two rails 23 for the rail vehicle 9 and, on the two side arms 10, with components for the operation of the magnetic vehicle 11. The operating components consist, for example, of vertical guide rails 24, horizontal rails 25 and the primary part 26 of a linear stator motor. The rails 23 and operating components 24, 25 and 26 are of the same construction and dimensions as the track 3a and they extend over the entire length of switch 4a, and therefore they can be traversed both by the rail vehicle 9 and by the magnetic vehicle 11. In contrast to conventional switches for rail vehicles, therefore, also the entire portion of the track section 21 carrying the rail vehicle and consisting of the rails 23 is flexed together with the beam 6a when the latter is to be aligned with track 1a or 2a.

Proper operation of the switches according to the invention is possible only when between its end and the adjoining branch track 1a or 2a a relatively wide gap 30 or 55 (FIGS. 3, 6, 11) of a width of, e.g., 80 to 150 mm, can be provided which will not interfere with the flexing of track section 21. But since such wide gaps can be traversed only by contactlessly operating magnetic vehicles, but not by wheels running on rails, an apparatus 31 is associated with switch 4a for the selective opening and closing of the gap 30. This apparatus 31 is either integrated into the switch or, as shown in FIGS. 3 to 6, it is inserted between switch 4a and a track section 32 at least of all those tracks which are to be traversed only or also by the rail vehicle, like track 1a in the example represented. The apparatus 31 serves two purposes. On the one hand it serves to form a sufficiently great gap 30 between the switch 4a and the track 1a in case the beam 6a is to be flexed back and forth. On the other hand the apparatus 31 is to close this gap 30 when track section 21 is connected to track 1a, doing so with allowance for the expansions and contractions acting on the rails, which can be caused by temperature changes or also by longitudinal forces which occur when the gap is crossed by a rail vehicle.

According to FIGS. 3, 4 and 6, in which the track section 21 is aligned with track 1a, the apparatus 31 contains two conventional, fixedly mounted rails 33 whose ends 33a produce the connection to the track section 32 next following, and are separated therefrom by conventional expansion joints 34 or the like, where they have a distance apart corresponding to the track width of track 1a. In a rail section 33b adjoining each of these ends 33a the rails 33 are fastened by conventional fastening means 35 to conventional ties 36. The rail sections 33b run parallel to one another up to about the point at 37 where they merge with rail sections 33c which diverge from one another taperingly since rails 33 are deflected slightly outward beginning at the point indicated at 37. They are deflected to such a degree that the rails 33 are at a distance apart at their other end 33d which is greater by twice the width of the rail head than the track width of track 1a. The ends 33d project slightly beyond a final tie 36a of the apparatus 31 and are separated from the associated ends of rails 23 of switch 4a by the gap 30 of the width b that is necessary for the shifting of the switch 4a (FIGS. 3 and 6).

The rail sections 33c have preferably, as shown in FIGS. 7 and 8, a cross-sectional shape corresponding to a rail cut back in the area of the flange and to one reinforced at the web, and therefore they have a machined head 38, a web 39, and a outlying half flange 40, while rail sections 33b (FIG. 9) are made in the same manner in their upper part, but have a full flange 41. The heads 38 and flanges 40 are in each case disposed on the outer side of the rail sections 33c and form each an inner slide surface disposed perpendicular to the ties and parallel to the length of the rails.

As shown in FIGS. 3 to 8, the apparatus 31 furthermore has two wedge-shaped, displaceably mounted rails 42 associated with one of the rail sections 33c, each with a web 43 and a flange 44 on the inside of the track. The web 43 and the flange 44 form on the outside of the rail 42 a slide surface disposed substantially perpendicular to the ties 36, which lies against the slide surface that is formed by the heads 38 and feet 40 of the associated rail section 33c. The flange 44 has the same width throughout and is displaceably mounted on the ties 36 by fastening means 45 which are at the same distance from the fastening means 35 throughout, so that when the rail 42 is pushed back and forth it will be guided between the fastening means 45 and the rail sections 33c with a sliding fit. The web 43 has a wedge shape in horizontal section and in plan and thus has a width that increases gradually from the apex 42a to a root 42b of the rail 42. It therefore has an inner guide surface 46 (FIG. 7) whose distance gradually increases from the slide surface of the rail 42 toward the root 42b. A tread surface 43a provided on the upper edge of web 43, like a tread surface 38a of head 38 of rail section 33c, serves as a tread surface of the same height for a wheel of the rail vehicle, while the guide surface 46 serves for the guidance of its flange.

The movable rails 42 have at their roots 42b a width which is precisely the same as the width of the tread surfaces of the rails 23 of switch 4a, and are disposed with their apexes 42a in the vicinity of the point indicated at 37 of apparatus 31. The shifting motion provided for the rails 42 corresponds at least to the width b of the gap 30 existing between the rails 23 and rail sections 33.

If it is desired to connect switch 4a to track 1a to allow a rail vehicle to pass, the rails 42 are shifted into the position shown in FIG. 3. In this position their roots 42b tightly engage the ends of rails 23 forming a fine abutment seam with the latter which previously have been aligned by appropriate operation of the switch 4a with track 1a. At the same time the associated tread surfaces and guiding surfaces of rails 23 and 42 are precisely aligned with one another, so that the set track width of track 1a remains virtually unchanged on account of the appropriately designed tapered shape of the rails 42 up to where their apexes 42a are disposed. In any case, in the area between the apexes 42a and the points indicated at 37, a slight increase in track width can occur, but one which can be kept within the track width tolerances even if the rails 42 should be subjected to greater wear in the area of the apexes 42a by making the length of the extension of the rail great and hence the taper angle correspondingly small. Besides, in the area 37 of the apparatus, a change will take place depending on the direction of travel of the rail vehicle, in the sense that its wheels will shift over from rail section 33b to rails 42 (and vice versa).

If it is desired, however, to turn the switch 4a in the direction of the arrows u or v (FIG. 3), i.e., so that it will be aligned with track 2a, the rails 42 are retracted to a position seen in FIG. 6, until their roots 42b are set about at the level of the ends 33d of rails 33. In this position there is a gap 30 of width b between the rails 23 on the one hand and rails 33 and 42 on the other, which permits any desired flexing of the beam 6a of the switch. Since the apparatus 31 when the rails 42 are in the retracted position, the reduction of the track width between the rails 42 which this entails is insignificant.

Any kind of driver can be provided for the displacement of the rails 42. Preferably, a pit 48 is provided under the apparatus 31 according to FIGS. 3, 4 and 6, on the bottom of which is mounted a driver 49 in the form of a cylinder-and-piston unit with a connecting rod disposed parallel to the rails 42. On a raised floor 50 in the pit 48 there is also mounted a stand on which a lever 52 is pivoted. While the one arm of this lever 52 is articulated to the connecting rod of the cylinder-and-piston unit 49, its other arm, as seen in FIG. 4, is pivoted on a push rod 53. The push rod 53 extends perpendicularly between the two rails 42 of the apparatus 31 and is affixed to the latter. By operating the cylinder-and-piston unit 49, the apparatus 31 can be set in one or the other direction as required. To compensate the slight track width changes which this produces between the rails 42 it is necessary only to fasten the push rod 53 to the rails 42 with sufficient free play.

In order to assure the proper operation of the switch system according to the invention under all conceivable conditions of operation, it is additionally provided with the devices which can be seen especially in FIGS. 10 and 11.

According to FIGS. 10 and 11, in which the end of beam 6a is aligned with the track 2a for the magnetic vehicles but is separated from it by a gap 55, the lateral guide rails 24 have at their ends the comb 56 consisting of a plurality of horizontal plates disposed one above the other. A corresponding vertically staggered set of plates is formed at the sides of the associated end of the track 2a. When the beam 6a and its track section 21 are aligned with track 2a or any other track that can be traversed by magnetic vehicles, the two combs 56, 57, intermesh with one another as shown in FIG. 10. This results in a surface formed by the combs 56, 57, which represents a continuation of the guide rails 24 and bridges the gap 55 between the associated ends of the beam 6a and the track 2a, so that those parts of the magnetic vehicles which are associated with the guide rails 24 will be unable to penetrate into the gap 55 even under unfavorable circumstances. Nevertheless, the gap 55 and the combs 56, 57, meshing with one another and disposed perpendicular to the flexing direction permit the desired flexing of beam 6a, since the combs 56 represented at the top of FIG. 10 can also pass through the combs 57 represented at the bottom in FIG. 10 when the beam 6a flexes.

On the other hand, a jacknife bridge 58 spanning the gap 55 is associated with the horizontal slide rails 25 at the lateral margins of the beam 6a and corresponding slide surfaces 25a on the track 2a, and is best housed in the associated end of track 2a. Each jacknife bridge 58 contains two limbs 59 spaced apart parallel to one another which are fastened at one of their extremities to an end of a shaft 60. The shaft 60 is journaled in bearings 62 fastened to track 2a in a pit 61 formed underneath the slide rail 25 and is disposed substantially perpendicular to the axis of the ways. The one end of a lever 63 is fastened to a middle portion of the shaft 60 and its other end is connected to a driver 64 and for this purpose is linked to the connecting rod of a cylinder-and-piston unit, for example. By moving the connecting rod back and forth the shaft 60 can be turned in the one or the other direction and each limb 59 can be raised and lowered in the direction of an arrow w visible in FIG. 11.

At those points of the end of beam 6a which are opposite the limbs 59 when it is aligned with track 2a, an opening 65 is provided in which an abutment 66 is recessed (cf. also FIGS. 3 and 6) on which the limbs 59 can be laid. The arrangement is made such that the top edges of the limbs 59 will, if they lie on the abutments 66, constitute a flush, large-area connection between the surface of the slide rail 25 and the slide surface 25a and span the gap 55 between the beam 6a and the track 2a. Therefore the parts of the magnetic vehicles which are associated with the slide rails 25 and the slide surfaces 25a can not penetrate into the gap 55 even under unfavorable operating conditions.

Finally, two rail joiners 67 disposed in the prolongations of the rails 23 are provided (FIGS. 3, 6 and 10). These have each a slot 68 of a size corresponding to the height and width of the roots 42b of the displaceable rails 42. In the case of a switchover to track 1a or any other track intended for use by rail vehicles, these slots 68 serve to accommodate the roots 42b by clamping them or interlocking with them and hold them firmly in engagement with the asosciated ends of the rails 23. Furthermore, clamping or plug-in means, not represented, can be associated with the rail joiners, which will lock the roots 42b in fixed position in the slots 68. This additionally assures that the rails 42 together with rails 23 will automatically accompany those movements which take place in their longitudinal direction as a result of temperature variations or of forces which occur when a rail vehicle passes through the switch. In this manner a proper operation of the switch 4a and of the apparatus 31 is assured even in the area of the gap 30. The clamping or plug-in means are best so made that they can be remotely controlled like the drivers 17, 49 and 58.

The rails 23 of the track section 21 mounted on the beam 6a are, as seen in FIGS. 3 and 6, mounted by fastening means 69 (FIGS. 3, 6) in the form of ribbed plates or the like on the supporting structure 22 and therefore, as is common practice in the construction of tracks for rail vehicles, they are mounted so as to be longitudinally displaceable to a certain extent. Thus it is possible on the one hand for the rails 23 to perform the movements made necessary by temperature variations or the like. On the other hand, the displaceable mounting is also necessary so that the rails 23 will be able, when the beam 6a flexes, to perform the movements relative to the fastening means 69 made necessary by bends in the track. Because flexing of the beam 6a produces the consequence that the free ends of the rails 23 on the inside relative to the free ends of the rails 23 on the outside are more greatly pushed forward in the direction of the branch line, and therefore the ends of the rails 23 are separated by different distances from the corresponding rail ends of the branch after a flexible.

To avoid this problem, in the case where the beam 6a is to be flexed to align it also with tracks which can be used by rail vehicles, an apparatus similar to apparatus 31 is provided according to the invention in the switch 4a. For this purpose the rails 23 are, for example, provided with sections which diverge wedge-wise toward the end of the beam 6a, on whose inner surfaces wedge-shaped rails corresponding to rails 42 are mounted with a sliding fit, whose apexes come to lie in a middle portion of the beam 6a. The roots of these wedge-shaped rails are, however, affixed to the end of the beam 6a by interlocking or clamping connections, so that they are always in the same position relative to one another regardless of the flexing of the beam 6a and the development of different distances between them and the branch tracks is not possible. When the beam flexes, however, the rest of the parts of the wedge-shaped rails can slide against the rails according to the state of flexure of the beam 6a and thus compensate changes in length due to different curvatures. The changes in track width caused thereby are slight, as in the case of apparatus 31, and if the taper angles are sufficiently small they can be kept within the necessary tolerances.

The invention is not limited to the embodiments described, which can be modified in many ways. It is possible, for example, to integrate apparatus 31 into the switches 4a or 4b and to construct it so that it can be used not only for opening and closing the gap 30 but also to prevent different distances between the rails after a flexure. The invention furthermore is not limited to switch systems which can be aligned only to one through track and one branch track, because in an expansion of the idea of the invention, more than two branch lines can be provided on both sides of a trunk line and the beams 6a and 6b could be flexed to both sides accordingly. Lastly, the invention is not limited to magnetic vehicles which hook around the tracks from the outside or which are in any other way secured for the prevention of derailments.

We claim:

1. Dual switch system for common use by track-guided rail vehicles and magnetic vehicles, comprising:

(a) a combined track (3a) on which the rail and magnetic vehicles can commonly run, and branch tracks (1a,2a) on which both the rail vehicles and magnetic vehicles or only rail vehicles or only magnetic vehicles can run, wherein the tracks on which the magnetic vehicles can run have first functional components, said components and the magnetic vehicles at least partially embracing each other for avoiding derailments of the latter, and wherein the tracks on which the rail vehicles can run are provided with first rails for the rail vehicles;

(b) a flexible track section (21) on which rail vehicles and magnetic vehicles can run and which is disposed between said combined track and said branch tracks, wherein said track section has a beginning for fixed connection to the combined track and an end for selective alignment with one of said branch tracks, wherein said track section has second functional components for the magnetic vehicle, said second functional components substantially corresponding to said first functional components and said second functional components and said magnetic vehicles at least partially embracing each other for avoiding derailments of the latter, wherein said track section is further provided with second rails for the rail vehicles, said second rails substantially corresponding to said first rails, and wherein gaps (30.55) are provided both between said second rails and said first rails of said branch tracks and said second functional components and said first functional components of said branch tracks for permitting the flexing of said track section;

(c) a flexible beam carrying said second functional components and said second rails of said track section;

(d) at least one actuating means (12–20) for commonly flexing said beam (6*a*) and said second functional components and said second rails of said track section;

(e) means for opening and closing said gaps (30) between said second rails and the first rails of each of said branch tracks on which said rail vehicles can run;

(f) and means for opening and closing said gaps (55) between said second functional components and the first functional components of each of said branch tracks on which said magnetic vehicles can run.

2. Dual switch system according to claim 1, wherein said means for opening and closing said gaps between said second rails and the first rails of each of said branch tracks include means for automatically compensating movements of said first and second rails in the longitudinal direction thereof caused by temperature variations or forces which occur when a rail vehicle passes through the switch.

3. Dual switch system according to claim 1, wherein said means for opening and closing said gaps between said second rails and the first rails of said branch tracks include means for automatically compensating movements of said second rails in the longitudinal direction thereof caused by the flexing of said beam and said second rails.

4. Dual switch system according to claim 1, wherein the track section (21) has at least two side arms (10) which can be partially encircled by the magnetic vehicles (11), and two rails (23) disposed between the arms and intended for the guidance of the rail vehicles (9).

5. Dual switch system according to claim 1, wherein the actuating means (12–20) has at least one frame (12) supporting the beam (6*a*) and mounted for displacement transversely of the track section (21), and a driving means (17) coupled therewith.

6. Dual switch system according to claim 1, wherein the means (31) for opening or closing the gaps between said second rails and the first rails of each of said branch tracks is disposed between the end of the beam (6*a*) and each of the branch tracks (1*a*) on which the rail vehicles (9) can travel.

7. Dual switch system according to claim 2, wherein the means for opening and closing the gaps between said second rails and the first rails of each of said branch tracks comprises: two fixedly mounted first rails (33) connected with one end (33*a*) to a respective branch track (1*a*) and having rail sections (33*c*) which diverge from one another wedge-like toward their other ends (33*d*), said other ends being separated by the gap (30) from the second rails of said track section (21) when the latter is aligned with them; two wedge-like rails (42,43), each of said rails being slidingly guided on the inside surface of said rail sections (33*c*) and having an apex (42*a*) pointing at said respective one end (33*a*) and a root (42*b*) pointing at the other end (33*d*); and driving means (49) for displacing the wedge-like rails (42) for opening or closing the gap (30).

8. Dual switch system according to claim 7, wherein at the end of the beam (6*a*) rail joiners (67) are fastened for the clamping or interlocking reception of the roots (42*b*) of the wedge-like rails (42) when the gap (30) is closed.

9. Dual switch system according to claim 3, wherein the track section (21) has two second rails mounted fixedly on the beam (6*a*) pointing with their one end to its beginning and diverging wedge-like toward their other end, and two wedge-like rails which are slidingly guided at the inner surfaces of said second rails, each wedge-like rail having an apex pointing to the beginning of the beam (6*a*) and a root disposed at the end of the beam and fastened fixedly to said beam.

* * * * *